US007390173B2

(12) United States Patent
Pasquan

(10) Patent No.: US 7,390,173 B2
(45) Date of Patent: Jun. 24, 2008

(54) WELL FLUID PUMPING ARRANGEMENT

(76) Inventor: Raymond Francis Pasquan, 11 Putney Road, Etobicoke, Ontario (CA) M8W 2K6

( * ) Notice: Subject to any disclaimer, the term of this patent is extended or adjusted under 35 U.S.C. 154(b) by 0 days.

(21) Appl. No.: 11/512,270

(22) Filed: Aug. 30, 2006

(65) Prior Publication Data

US 2008/0056921 A1 Mar. 6, 2008

(51) Int. Cl.
*F04B 1/00* (2006.01)
*F04B 23/04* (2006.01)

(52) U.S. Cl. ..... 417/529; 417/523

(58) Field of Classification Search ..... 417/529, 417/530, 523, 257, 263; 74/41, 108
See application file for complete search history.

(56) References Cited

U.S. PATENT DOCUMENTS 225,946 A * 3/1880 Reece ..... 417/529
803,152 A * 10/1905 Cole ..... 417/529
2,187,679 A * 1/1940 Chambers ..... 417/529
3,136,166 A * 6/1964 Journeay ..... 74/41
4,191,514 A * 3/1980 Ely et al. ..... 417/529
5,765,639 A 6/1998 Muth ..... 166/72
5,873,411 A 2/1999 Prentiss ..... 166/105
5,934,372 A 8/1999 Muth ..... 166/72
6,508,308 B1 1/2003 Shaw ..... 166/313
6,585,049 B2 7/2003 Lenick, Sr. ..... 166/369

* cited by examiner

*Primary Examiner*—Devon Kramer
*Assistant Examiner*—Peter J Bertheaud

(57) ABSTRACT

A liquid well pumping arrangement, especially for oil wells, comprising a pair of adjacent downhole reciprocating pumps each having a barrel, a piston rod connected to a piston slidable within the barrel, and valves adapted to cause liquid to flow from a lower inlet of the barrel to an upper outlet from the barrel when the piston is reciprocated in the barrel. The arrangement includes a well head pumping mechanism for applying reciprocating movement to sucker rods to cause movement of the pistons, the well head pumping mechanism being arranged to reciprocate each of the pistons at the same cyclic rate but with the motions of the two pistons being out of phase by 180°. A single delivery tube is connected to both of the outlets from the barrels such that, with the pumping mechanism operating, a substantially continuous flow of liquid can be produced from said delivery tube.

5 Claims, 7 Drawing Sheets

156
147a
163a
163a'
150a
140a
142a
UP
STROKE
146a
148a
SECTION 2-2
2

WELL FLUID PUMPING ARRANGEMENT

BACKGROUND OF THE INVENTION.

1. Field of the Invention

The present invention relates to fluid pumping arrangements for wells, intended to give an increased rate of recovery and/or better efficiency in pumping. The invention is particularly valuable for oil wells, but may be used for other liquids such as water.

2. Prior Art

Presently, most oil is pumped from oil wells using downhole reciprocating pumps. Such a pump has a well head pumping mechanism causing reciprocating movement of a sucker rod which operates the down hole pump. The latter pump has a piston rod operating a piston slidable within a barrel, and has valve means in the piston and barrel which cause the oil to be lifted on each upstroke of the sucker rod. With a single-acting pump of this kind the rod operates almost entirely in tension. Such single acting pumps cannot maintain a steady flow of oil, and the need to accelerate a long column of oil in the well with each stroke is a major factor in the energy required for pumping oil or other liquids.

Another source of losses in conventional reciprocating pumps is the frictional resistance between the sucker rods and the column of liquid in which they move, which may be substantial given that the column of liquid may be hundreds of feet long.

Proposals have been made for double acting pumps which could give a more even delivery of oil by producing an output both on the upstroke and the downstroke; such proposals are shown for example in the following U.S. patents:

U.S. Pat. No. 6,585,049, issued Jul. 1, 2003 to Lenick, Sr., and

U.S. Pat. No. 5,873,411, issued Feb. 23, 1999 to Prentiss.

Proposals such as these, for double acting pumps, are either complicated, as in the Prentiss patent, or, as with the Lenick, Sr. patent, they require the sucker rods or their equivalent to apply downwards forces, which means these rods either have to be rigid, or have to be heavily weighted at the bottom so that they are not subjected to significant compressive forces. Compressive forces are normally avoided or minimized since these rods may be very long.

Another form of downhole pump is a rotary auger-type pump, sometimes termed a "progressive cavity pump", as manufactured by Moyno Oilfields Products of Tulsa, Okla., which can give a substantially constant output. However, such pumps are less efficient than is desirable.

SUMMARY OF THE INVENTION

The present invention seeks to overcome these drawbacks of the prior art by retaining generally conventional, high efficiency, single-acting, reciprocating pumps, but using them in tandem and connecting them in such a way that they operate in an out-of-phase manner and together provide a generally continuous flow of oil, or other liquid, at the well head, thus reducing the energy requirements relative to the amount of liquid being pumped.

According to one aspect of the present invention, a liquid well pumping arrangement comprises:

a pair of adjacent downhole reciprocating pumps each having a barrel, a piston rod connected to a piston slidable within the barrel, and valve means adapted to cause liquid to flow from a lower inlet of the barrel to an upper outlet from the barrel when the piston is reciprocated in the barrel;

sucker rod means attached to the piston rod of each pump;

a well head pumping mechanism for applying reciprocating movement to each of the sucker rod means to cause movement of the pistons;

wherein said well head pumping mechanism is arranged to reciprocate each of said sucker rod means at the same cyclic rate but with the motions of the two sucker rod means being out of phase by 180°;

and wherein there is provided a single delivery tube connected to both of the outlets from the barrels such that, with the pumping mechanism operating, a substantially continuous flow of liquid can be produced from said delivery tube.

The two pump barrels may be arranged side-by-side, or may be arranged at different levels. In the latter case, the pair of pumps may be arranged to occupy minimal overall cross-sectional area of the well bore by having an upper pump barrel located wholly above a lower pump barrel, with said upper pump barrel having an axis which is off-set from that of the lower pump barrel but which, when projected, lies within the boundaries of the lower pump barrel. The term "adjacent", as applied to the pumps, includes both the side-by-side arrangement and the off-set arrangement at different levels; it means that the pumps are in the same bore and receiving liquid from essentially the same source.

Preferably the two pumps are identical, having the same diameter and stroke.

A preferred liquid well pumping arrangement in accordance with the invention, comprises:

a pair of adjacent downhole reciprocating pumps each having a barrel, a piston rod connected to a piston slidable within the barrel, and valve means adapted to cause liquid to flow from a lower inlet of the barrel to an upper outlet from the barrel when the piston is reciprocated in the barrel, said pumps including an upper pump and a lower pump, the upper pump barrel being located wholly above the barrel of the lower pump, with said upper pump barrel having an axis which is off-set from that of the lower pump barrel but which, when projected, lies within the boundaries of the lower pump barrel, first and second sucker rod means attached respectively to the piston rods of the upper pump and lower pump, said second sucker rod means including a pair of rods which are connected to the piston rod of the lower pump and which are spaced apart so as to straddle a portion of the upper pump barrel, a well head pumping mechanism for applying reciprocating movement to each of the sucker rod means to cause movement of the pistons;

said well head pumping mechanism being arranged to reciprocate each of said sucker rod means at the same cyclic rate but with the motions of the first sucker rod means being out of phase with motions of the second sucker rod means by 180°;

and wherein there is provided a single delivery tube connected to both of the outlets from the pump barrels such that, with the pumping mechanism operating, a substantially continuous flow of liquid can be produced from said delivery tube.

The outlets from the pump barrels preferably have angled sections which merge smoothly together into the delivery tube, and the piston rods pass out of these angled sections via sealing sleeves which prevent escape of the pressurized liquid. Thus the main length of the sucker rods pass beside the delivery tube, so that, unlike with a conventional reciprocating pump, there is no contact, and therefore no frictional resistance, between the sucker rod means and the liquid being pumped.

Also, the fluid friction resistance within the delivery tube is significantly reduced because the high fluid pressure normally produced with each upward lift of the oil column, in a conventional single pump arrangement, may be greatly reduced; i.e. the fluid pressure may be far lower and more even with two pumps than with the conventional single pump. This is in addition to the advantage of having the delivery tube offset from the polished rods so that no pressure seals are required at the well head.

The well head pumping mechanism may include a pair of pump jacks arranged head-to-head and conventional adjacent to each other, and linked together either by electrical control means or by a mechanical connection. The mechanical connection may be a flexible member such as a chain or toothed belt having each of its ends connected to one of the horse heads and having its intermediate length passing over a pulley held above the two horse heads. Preferably however the pumping mechanism includes a rotatable crankshaft having two cranks off-set from each other at 180°, and connecting rods connecting a first of said cranks to a first of the sucker rod means and also connecting a second of said cranks to a second of the sucker rod means.

BRIEF DESCRIPTION OF THE DRAWINGS.

Preferred embodiments of the invention will now be described by way of example with reference to the accompanying drawings, in which.

DETAILED DESCRIPTION

Figure 1D:
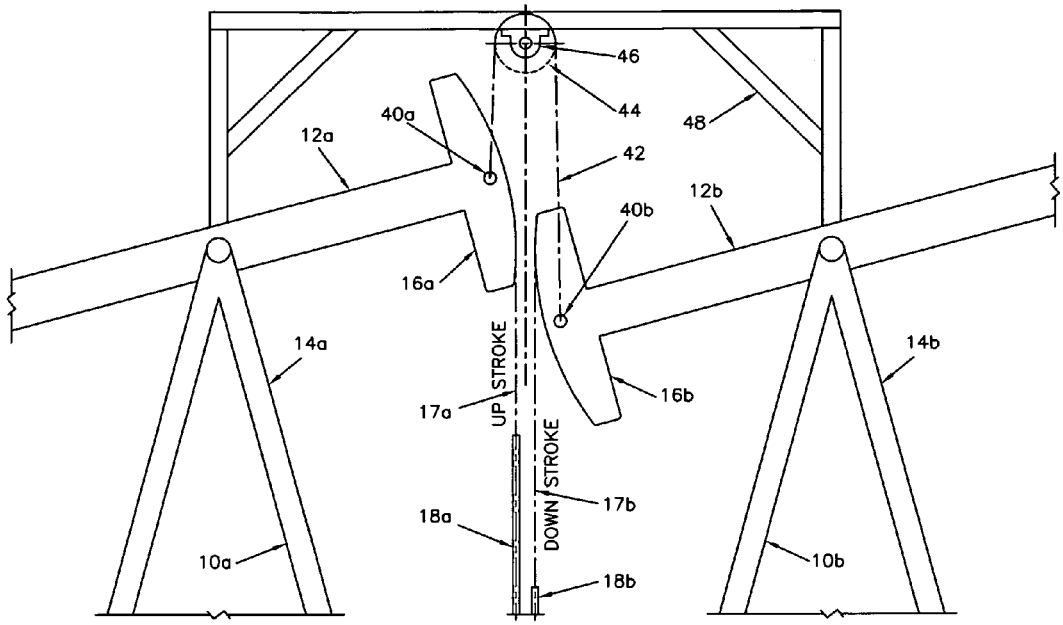
FIG. 1*d* shows a front view of a well head pumping arrangement similar to that of FIG. 1, but with a mechanical connection between the horse heads.
Figure 1A:
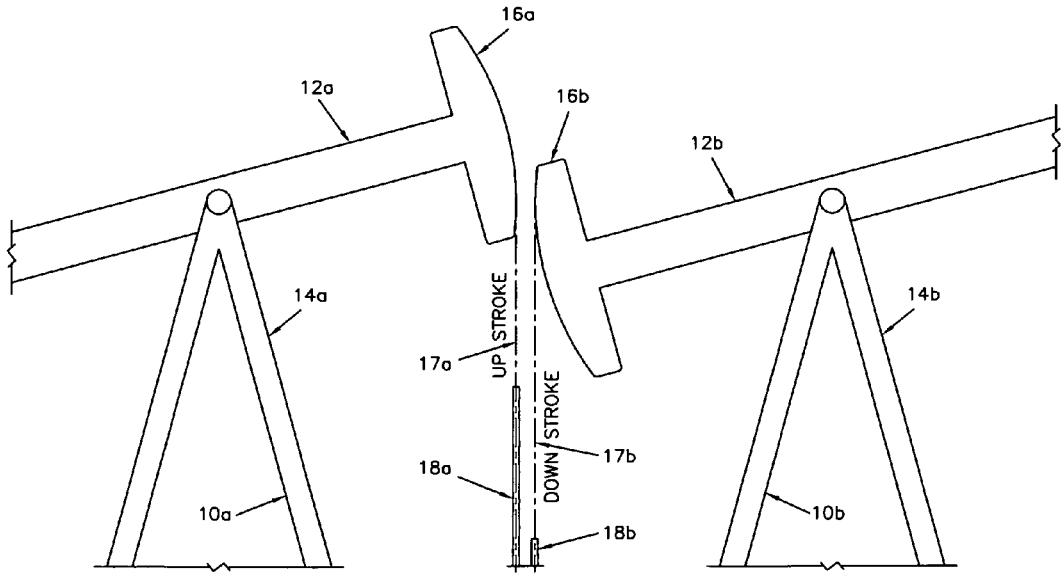
FIG. 1*a* shows a front view of a well head pumping mechanism in accordance with one aspect of the invention.

FIG. 1*a* shows a tandem arrangement of two conventional oil well head pumping mechanisms or pump jacks 10*a* and 10*b* of the type each having a walking or rocking beam 12*a*, 12*b* mounted on respective samson posts 14*a*, 14*b* and each having a cable track or horse head 16*a*, 16*b* carrying cables 17*a*, 17*b* connected to polished rods 18*a*, 18*b*. The pumping mechanisms are arranged head to head so that the polished rods 18*a*, 18*b* are close together, probably no more than a few inches apart. Also, means are provided, which may be mechanical or may be electrical control means, to ensure that the pumping units operate at the same rate but are 180° out of phase with each other.

Figure 1C:
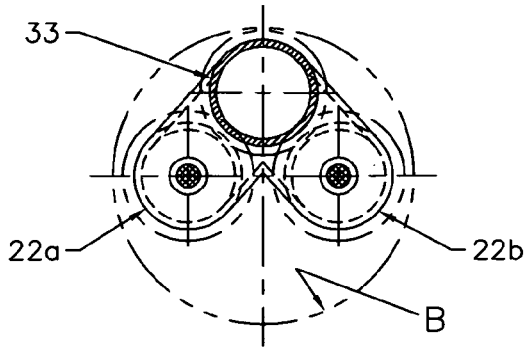
FIG. 1*c* shows a cross-sectional view of the same pump arrangement, taken on lines 1*c*-1*c* of FIG. 1*b;*
Figure 1B:
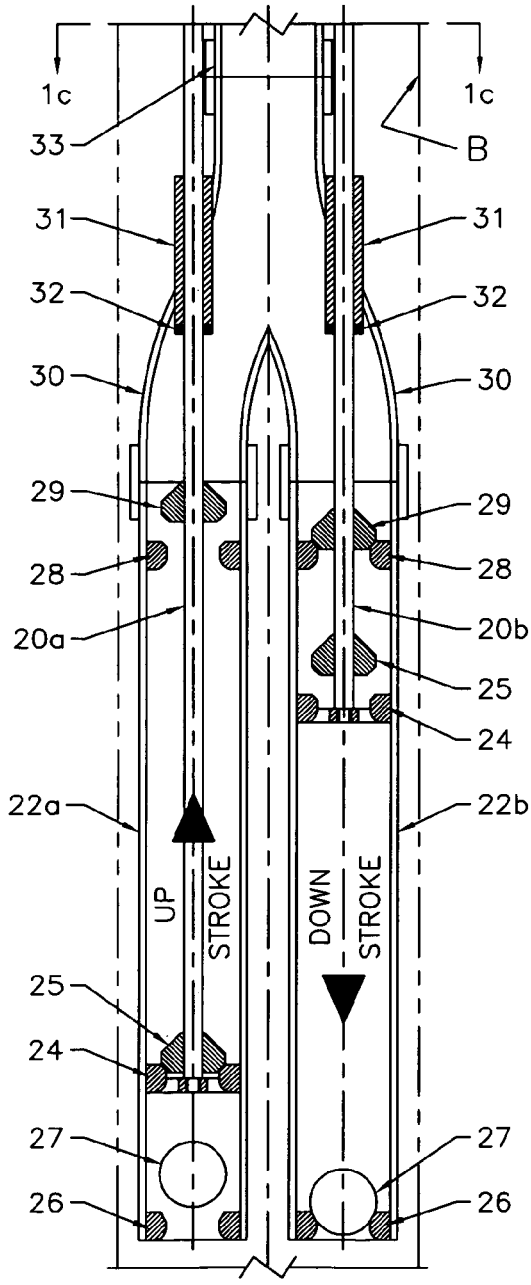
FIG. 1*b* shows a front view of a pair of tandem pumps, such as may be connected to the various well head pumping mechanisms described herein.
Figure 3A:
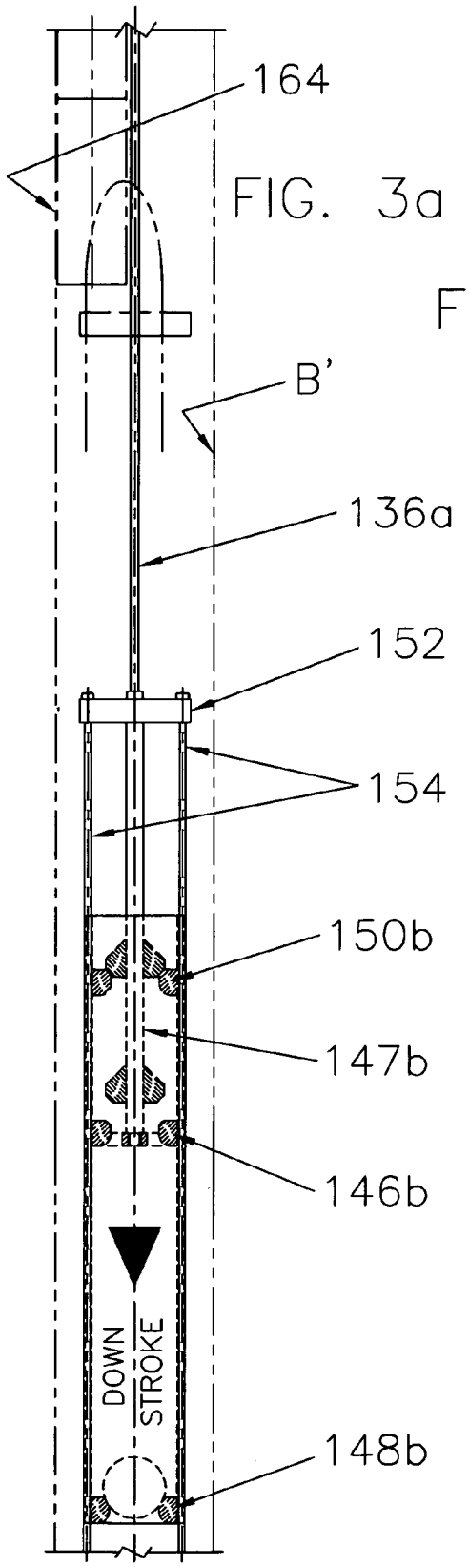
FIGS. 3*a* and 3*b* show side views of the pumping arrangement of FIGS. 2*a* and 2*b;*

Each polished rod 18*a*, 18*b* is connected via a sucker rod (not shown) to a piston rod 20*a*, 20*b*, seen in FIG. 1*b*. As shown in the latter figure, each piston rod operates one of two conventional pump units 22*a*, 22*b*, arranged close together in a well bore B. As indicated in FIG. 1*b*, each pump has a piston 24 with a one-way valve 25, and operates between a bottom inlet 26 with valve 27, and a top outlet 28 with valve 29, all these parts being conventional. As also indicated in FIG. 1*b*, the outlets 28 of both pumps are connected to outlet conduits 30 which slope towards each other and merge together a short distance above the top pump outlets, so that when both pumps are operated in a 180E out of phase manner a mostly steady flow of oil is provided up a delivery tube 33. The delivery tube 33 is offset to a side of the pumps so that the pumps and tube 33 form a triangular arrangement as seen in cross section in FIG. 1*c*.

As shown in FIG. 1*b*, the outlet conduits 30 have inwardly upwardly sloping outer side walls provided with bushings 31 through which the piston rods 20*a* and 20*b* pass, seals 32 being provided on the inner ends of these bushings to prevent oil leaking out of the conduits at these points. The provision of these seals avoids the usual need for seals around the polished rods 18*a*, 18*b*. Also, the fact that the sucker rods are outside the delivery tube avoids the usual friction between the sucker rods and the liquid being pumped.

FIG. 1*d* shows a modification of the well head pumping mechanism of FIG. 1*a*, in which the horse heads 16*a*, 16*b* have a mechanical-connection to ensure that they remain 180° out of phase. For this, the horse heads 16*a*, 16*b* are connected at 40*a*, 40*b* to opposite ends of chain or toothed belt 42, and the intermediate part of this belt passes over pulley 44 which is carried by bearing 46 mounted on frame 48 at a position above the horse heads and centrally positioned with respect to these horse heads and to the polished rods 18*a*, 18*b*.

FIGS. 2*a*, 2*b*, 3*a* and 3*b* show a preferred form of pump arrangement in which the pumps are arranged at upper and lower levels and nested together so as to fit into a bore B' of an oil well that is narrower than the bore B of FIG. 1*b* needed by the side-by-side pumps.

Figure 2A:
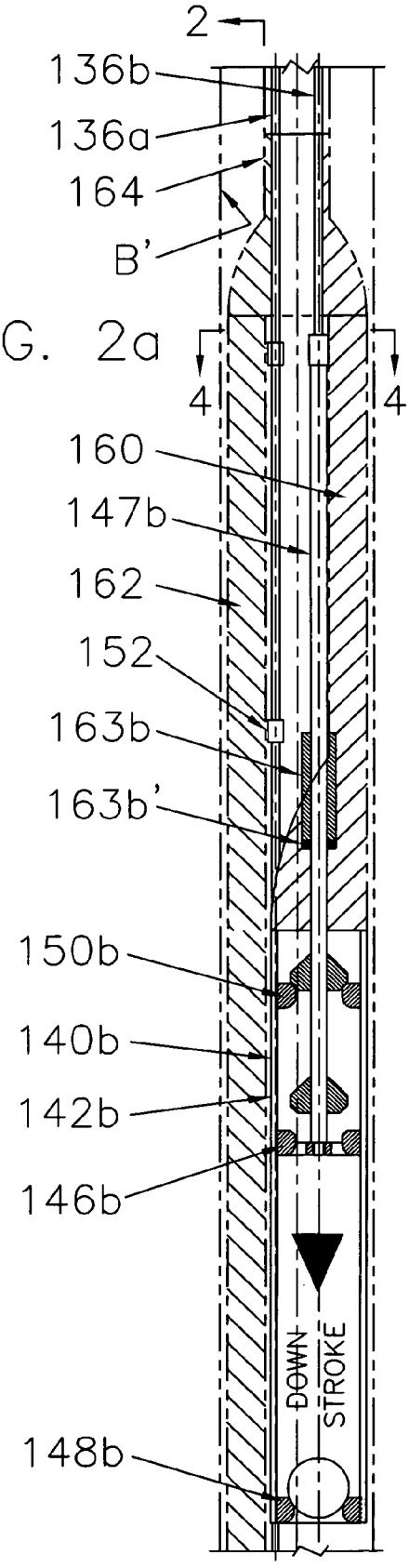
FIGS. 2*a* and 2*b* show front views of upper and lower parts, respectively, of a pumping arrangement suitable for connection to the various well head mechanisms described herein.
Figures 2B, 3B:
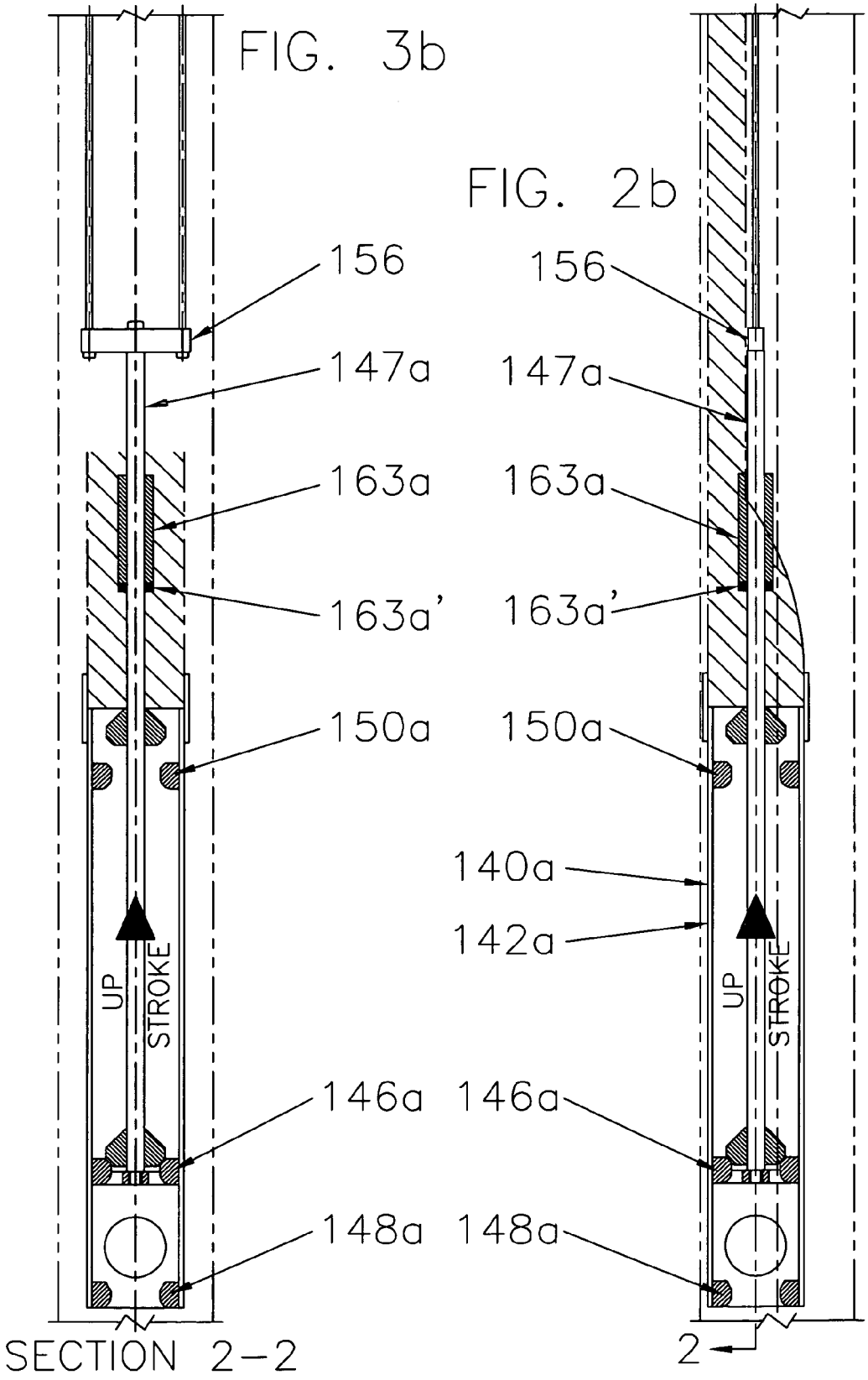
Figure 4:
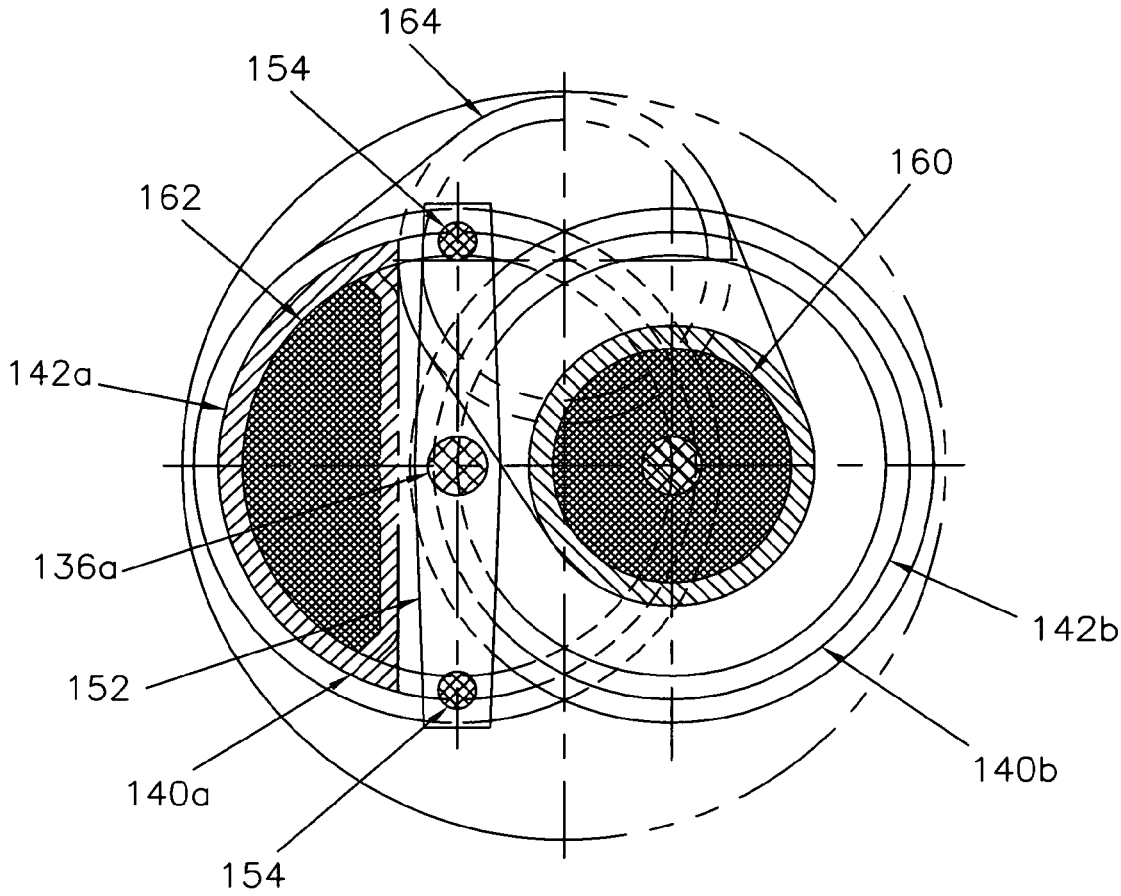
FIG. 4 shows a cross-section through the pumping arrangement, taken on lines 4-4 of FIG. 2*a*.

As shown in FIGS. 2*a*, 2*b*, 3*c*, 3*d* and 4, the pump arrangement includes lower pump 140*a* and upper pump 140*b*, operated respectively by sucker rods 136*a* and 136*b*. Each pump has a barrel 142*a* and 142*b*, these barrels being vertically separated by a substantial height which is greater than the barrel length, and being laterally off-set but sufficiently close that, as seen in FIG. 4, the axis of the lower pump, which corresponds to the axis of rod 136*a* if extended, lies within the circumference of the upper pump barrel 142*b*. Each pump has the usual piston 146*a*, 146*b* acting between a lower valved inlet 148*a* and 148*b* and an upper valved outlet 150*a*, 150*b*.

The upper pump piston 146*b* has its piston rod 147*b* connected directly to the sucker rod 136*b* in the usual way, and draws liquid up the well casing through passages which pass beside the lower pump. The lower pump draws liquid directly from the bottom of the well casing, and in this case the piston 146*a* has its piston rod 147*a* connected indirectly to the sucker rod 136*a* to avoid interference with the upper pump barrel 142*b*. For this purpose the sucker rod 136*a* terminates above the upper pump barrel 142*b*, where it is connected to an upper cross-head 152 which, in turn, connects to two depending, parallel rods 154 spaced to straddle, and lie just outside of, the upper pump barrel 142*b*, as best shown in FIG. 4. Lower ends of these rods 154 are connected to a lower cross-head 156, the center of which holds lower piston rod 147*a* which in turn is connected to the lower pump piston 146*a*. By these means the axes of the two pumps can be close together, while allowing the lower pump to be operated without interference from the upper pump.

As shown in FIGS. 2*a*, 2*b* and 4, the upper pump 140*b* has its outlet connected to an outlet pipe 160 which is co-axial therewith, while the lower pump 140*a* has its outlet connected to an outlet pipe 162 of roughly semi-circular cross section which extends up from the top of the lower pump beside the upper pump barrel, at the side of the pump arrangement opposite the upper pump outlet pipe 160. This outlet pipe 162 meets the outlet pipe 160 shortly above the upper pump 140*a*, where both these pipes 160 and 162 are smoothly merged into a main delivery tube 164 which has its axis off-set to one side of the pipes 160 and 162, and which carries the oil to the surface. As in the previous embodiment, the piston rods 147*a* and 147*b* of the lower and upper pumps pass out of the liquid delivery tubes 162 and 160 via bushings 163*a* and 163*b*, escape of liquid being prevented by associated seals 163*a*' and 163*b*', so that the sucker rods are outside the liquid column, and no polished rod seals are required at the well head.

The various pump parts, outlet tubes, and delivery pipe are held together by rigid interconnections between the parts, such as the outlet tubing and the delivery tubes, and there is no need for an outer casing.

A third arrangement of pumps would use upper and lower pumps, as in the previously described embodiment, having slightly increased distance between centrelines, such that the piston rod of the lower pump, with attached suction rod, would bypass the upper pump barrel. This means that the dual bypass rods and cross heads would not be required. Of course, this arrangement, although simpler in design, would result in slightly smaller diameter pumps in any given well, and oil output would be less than in the previous embodiment.

Figures 5A, 5B:
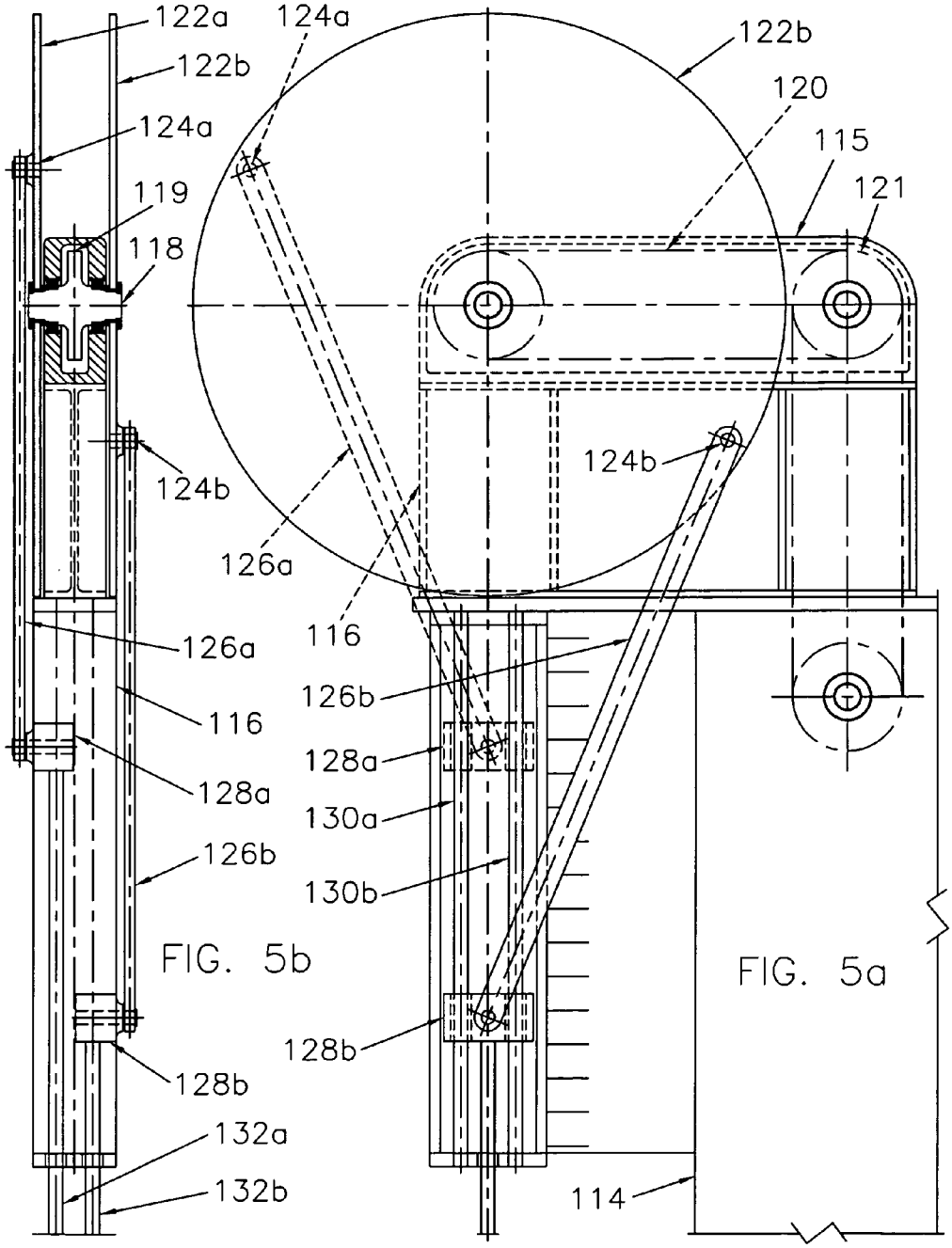
FIG. 5*a* shows a front view of a preferred form of well head pumping mechanism such as may be connected to the various pumping arrangements shown herein.
FIG. 5*b* shows a side view of the pumping mechanism of FIG. 5*a;*

FIGS. 5*a* and 5*b* show one embodiment of a preferred form of pumping mechanism at the well head. This includes a gear case 114 provided, near its base, with a drive motor (not shown), and carrying a fixed horizontal chain case 115 at its upper end, the outer end of chain case 115 in turn being attached to a depending, vertical support 116. The driven end of chain case 115 has journals supporting a horizontal shaft 118 with sprocket wheel 119 driven from the drive motor by sprocket chains 120 which pass along the chain case and are connected, by a further sprocket wheel 121 and a chain carried thereby, to the drive motor in the gear case 114. The shaft 118 carries two circular side plates 122*a*, 122*b* located on opposite sides of chain case 115, and which provide thin strong plates for mounting connecting rods to be described.

The outer sides of the side plates 122*a*, 122*b* each have a crank pin 124*a*, 124*b*, these crank pins being located at diametrically opposed positions on the side plates. Each crank pin 124*a*, 124*b* is connected by a connecting rod 126*a*, 126*b* to a cross head 128*a*, 128*b*. Each cross head is vertically slidable on a pair of vertical, parallel rods 130*a*, 130*b*, each pair of rods being associated with one side of the vertical support 116. As best seen in FIG. 5*b*, each of these cross heads is connected to a polished rod 132*a*, 132*b*, these being reciprocated vertically at the same rate but 180° out of phase with each other.

The polished rods 132*a*, 132*b* could be used to operate the two pumps 22*a*, 22*b* described with reference to FIGS. 1*b* and 1*c*, as well as to operate sucker rods 136*a*, 136*b*, of the preferred pump arrangement shown in FIGS. 2*a*, 2*b*, 3*a*, 3*b*, and 4, as described.

Figure 6A:
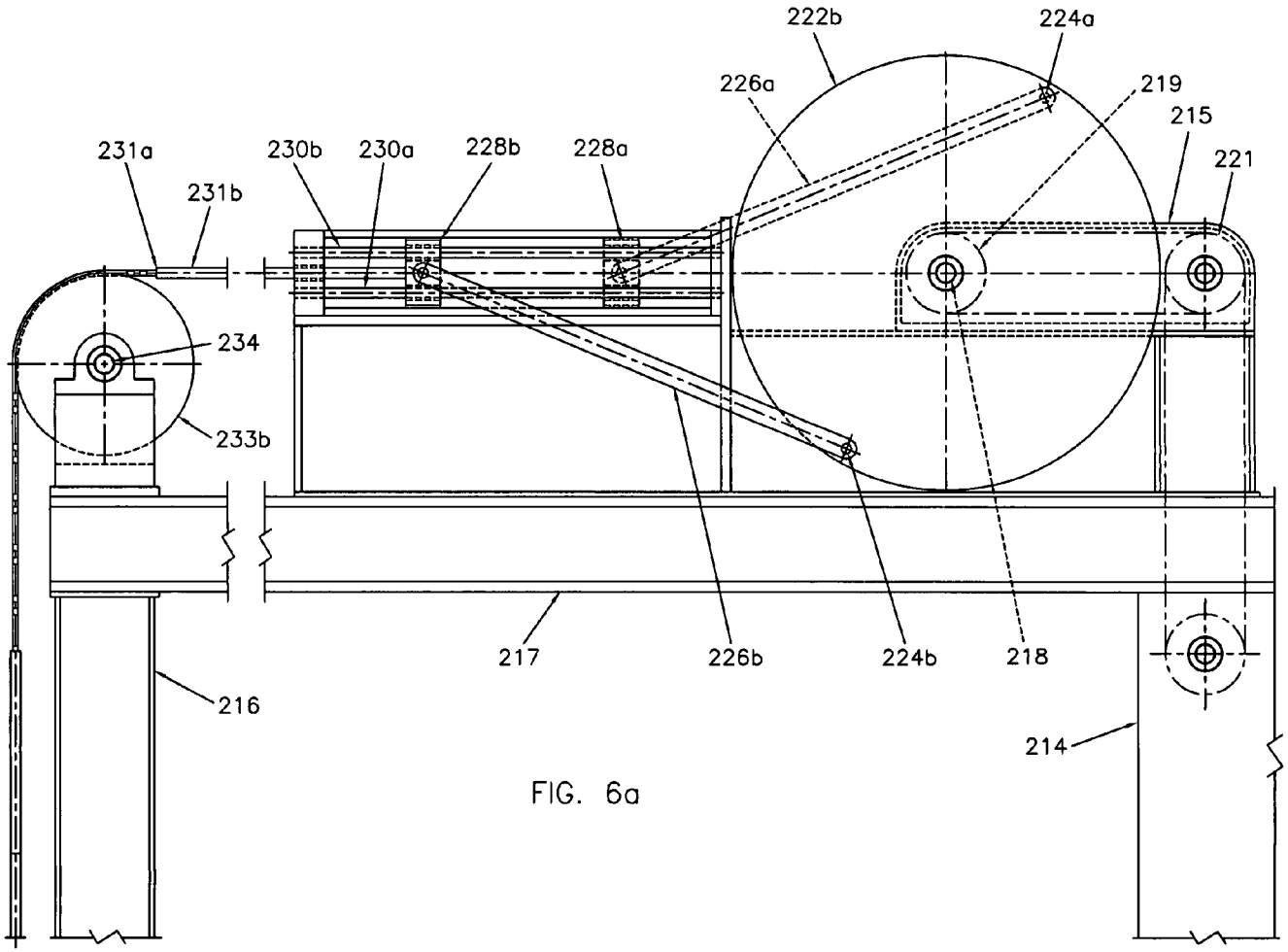
FIG. 6*a* shows a front view of an alternative form of pumping mechanism.
Figure 6B:
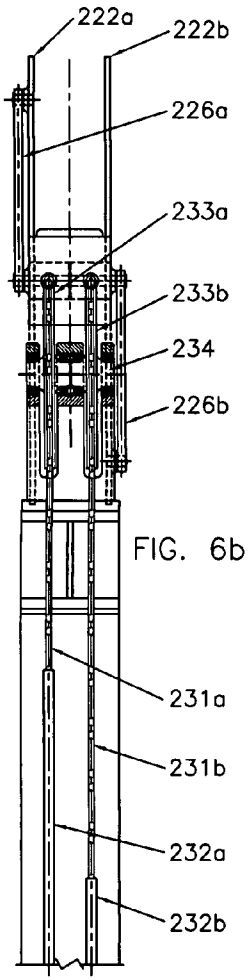
FIG. 6*b* shows a side view of the FIG. 6*a* pumping mechanism.

FIGS. 6*a* and 6*b* show yet another embodiment of the preferred form of well head pumping mechanism using a wheel with diametrically opposed cranks. This includes a gear case 214 carrying one end of a horizontal beam 217 the other end of which beam is carried by a support 216. The gear case 214 is provided, near its base, with a drive motor (not shown) which drives a sprocket chain connected to an upper sprocket wheel 221. This latter sprocket wheel is located at one end of a fixed horizontal chain case 215, the outer or driven end of chain case 215 having journals supporting a horizontal shaft 218 with sprocket wheel 219 driven from the drive motor by sprocket chains which pass along the chain case and are connected, by the upper sprocket wheel 221, to the drive motor in the gear case 214. The shaft 218 carries two circular side plates 222*a*, 222*b* located on opposite sides of chain case 215, and which provide thin strong plates for mounting connecting rods to be described.

The outer sides of the side plates 222*a*, 222*b* each have a crank pin 224*a*, 224*b*, these crank pins being located at diametrically opposed positions on the side plates. Each crank pin 224*a*, 224*b* is connected by a connecting rod 226*a*, 226*b* to a cross head 228*a*, 228*b*. Each cross head is horizontally slidable on a horizontal slideway constituted by a pair of horizontal, parallel rods 230*a*, 230*b* supported by the beam 217, and each cross head is connected to one end of a sprocket chain 231*a*, 231*b*, these chains undergoing a 90° change of direction by passing over sprocket pulleys 233*a* and 233*b* held on an axle 234 above the vertical support 216. As best seen in FIG. 6*b*, a vertically hanging, outer end portion of each of these chains 231*a*, 231*b* is connected to a polished rod 232*a*, 232*b*, so that the polished rods are reciprocated vertically at the same rate but 180° out of phase with each other. Other flexible members such as cables or flat belts can be substituted for the chains.

In the embodiments of FIGS. 5 and 6 the sucker rod strings fully balance each other; i.e. the design is fully balanced and there is no need of counterweights as with the conventional pumping jacks of FIG. 1.

I claim:

1. A liquid well pumping arrangement comprising: a pair of adjacent downhole reciprocating pumps each having a barrel, a piston rod connected to a piston slidable within the barrel, and valve means adapted to cause liquid to flow from a lower inlet of the barrel to an upper outlet from the barrel when the piston is reciprocated in the barrel;

said pumps including an upper pump and a lower pump, the upper pump barrel being located wholly above the barrel of the lower pump, with said upper pump barrel having a central axis which is off-set from a central axis of the lower pump barrel; wherein the central axis of the upper pump barrel lies within the boundaries of the lower pump barrel; first and second sucker rod means attached respectively to the piston rods of the upper pump and lower pump, said second sucker rod means including a pair of rods which are connected to the piston rod of the lower pump and which are spaced apart so as to straddle a portion of the upper pump barrel;

a well head pumping mechanism for applying reciprocating movement to each of the sucker rod means to cause movement of the pistons;

said well head pumping mechanism being arranged to reciprocate each of said sucker rod means at the same cyclic rate but with the motions of the first sucker rod means being out of phase with motions of the second sucker rod means by 180°;

and wherein there is provided a single delivery tube connected to both of the outlets from the pump barrels such that, with the pumping mechanism operating, a substantially continuous flow of liquid can be produced from said delivery tube.

2. A pumping arrangement according to claim 1, wherein the outlets from the pump barrels have angled sections which merge into the delivery tube, and wherein the piston rods pass out of the angled sections of these outlets via sealing sleeves which prevent escape of pressurized liquid, whereby at least the main length of said sucker rod means are outside of a liquid column in said delivery tube.

3. A pumping arrangement according to claim 1 wherein said well head pumping mechanism includes a rotatable crankshaft having two cranks off-set from each other at 180°, and a connecting rod connecting a first of said cranks to a first of the sucker rod means and a second of said cranks to a second of said sucker rod means.

4. A pumping arrangement according to claim 3, wherein said connecting rods are each connected to a crosshead slidable on a horizontal slide, each crosshead being connected to said sucker rod means via a flexible member, said flexible member passing over a pulley which changes the direction of the flexible member by 90°.

5. A pumping arrangement according to claim 1, wherein said well head pumping mechanism includes a pair of walking beams disposed with their horse heads adjacent each other, and wherein said horse heads are connected by flexible means passing over a pulley, said pulley being held above the horse heads.

* * * * *